United States Patent [19]

Townsend

[11] 4,170,345

[45] Oct. 9, 1979

[54] HOLDING CLAMP ASSEMBLY

[76] Inventor: Ralph G. Townsend, 4882 J Pkwy., Sacramento, Calif. 95823

[21] Appl. No.: 860,050

[22] Filed: Dec. 13, 1977

[51] Int. Cl.[2] ..... B25B 1/02

[52] U.S. Cl. ..... 269/88; 269/99; 269/203; 269/211; 269/247

[58] Field of Search ..... 269/203, 165, 207-215, 269/99-100, 88, 246-247

[56] References Cited

U.S. PATENT DOCUMENTS

| | | | |
|---|---|---|---|
| 841,012 | 1/1907 | Helm | 269/212 |
| 990,186 | 4/1911 | Berg | 269/247 |
| 1,024,728 | 4/1912 | Jackson | 269/203 |
| 1,026,475 | 5/1912 | Tarbuck | 269/100 |
| 1,529,281 | 3/1925 | Taylor | 269/208 |
| 1,766,230 | 6/1930 | Sed | 269/246 |
| 3,357,697 | 12/1967 | Zanitsch | 269/203 |

*Primary Examiner*—Robert C. Watson
*Attorney, Agent, or Firm*—Blair, Brown & Kreten

[57] ABSTRACT

Disclosed herein is a holding clamp assembly disposed on a table having parallel trackways disposed thereon. Riding within these trackways are diverse types of clamping mechanisms which cooperate and coact with one another to provide retention means for objects to be worked on. In one embodiment, the clamping devices comprise opposed parallel faces which engage the object to be worked on. Another embodiment the clamping mechanism is defined by L-shaped clamps having clamping screws disposed at one extremity to engage a work piece between the table surface and the screw clamp.

9 Claims, 7 Drawing Figures

FIG.1
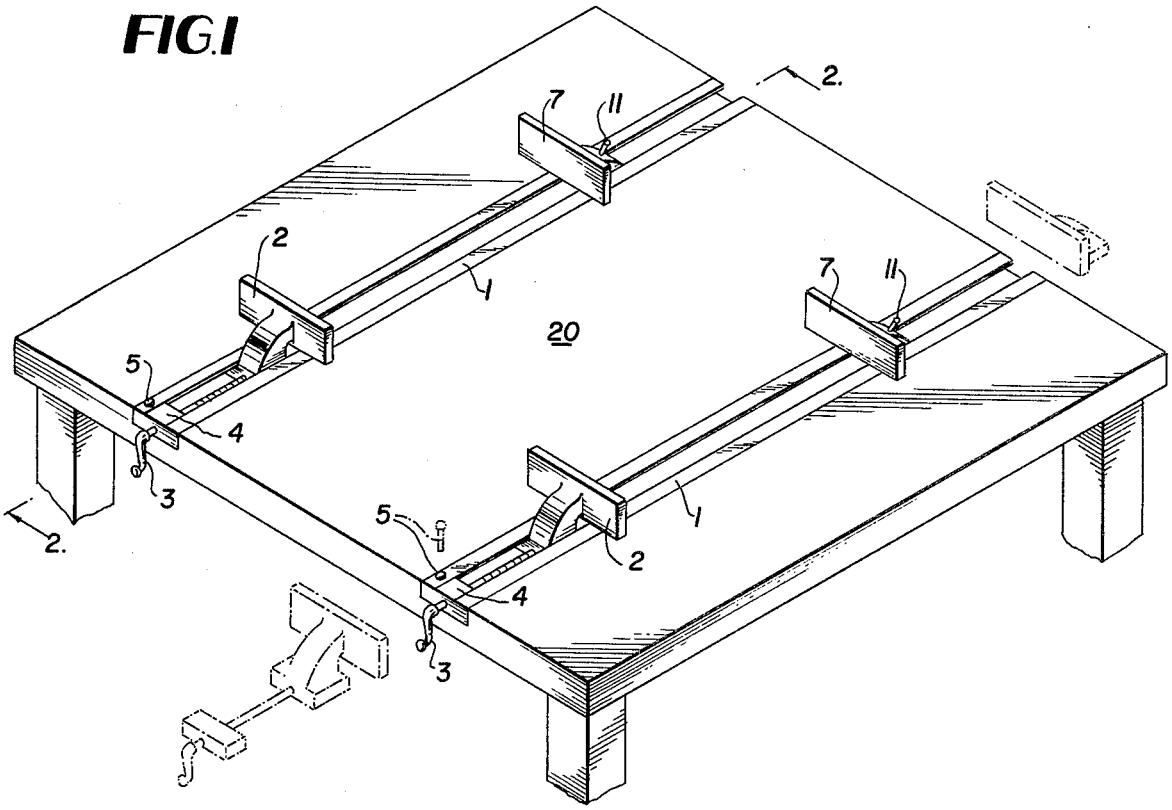
FIG.7
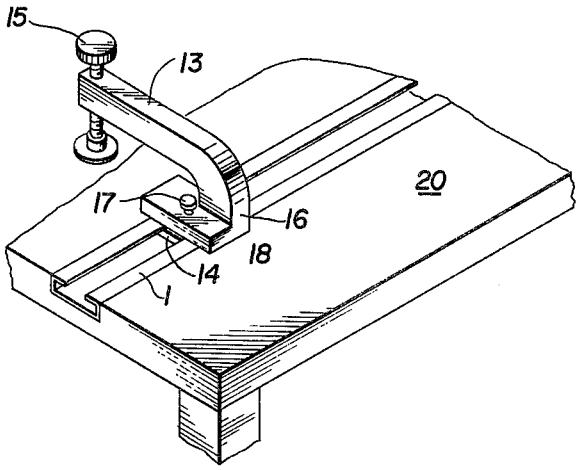
FIG.4
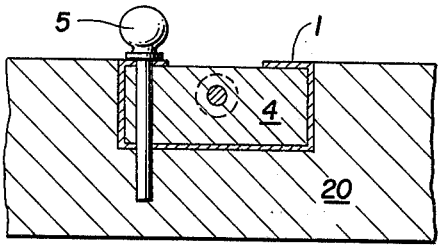
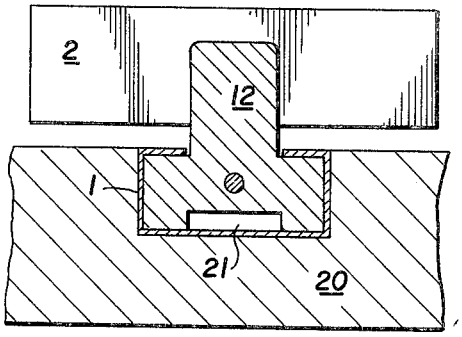
FIG.5

HOLDING CLAMP ASSEMBLY

BACKGROUND OF THE INVENTION

Field of the Invention

With todays spiraling labor cost, it is imperative that efficiency be increased by minimizing the number of artisans required to perform diversed type crafts. To this end, a work table which can constrain an object to be worked on would tend to eliminate the need for unskilled assistants when a person would be required to hold or constrain an object to be worked on. In addition however operations that require time for example to allow glued objects to set demand that a constraint be used which is flexible and provides a large variety of orientations to accommodate work objects of various configurations.

Prior art devices, of which applicant is aware, include the following U.S. Pat. Nos. 187,117, 330,643, 1,518,709, 1,553,669, and 1,574,528. It is to be noted that none of the above cited references disclose the specific structure and slotted mounting configurations of the hereinbelow disclosed working clamps and consequently the following disclosure constitutes an improvement of the state of the art.

SUMMARY OF THE INVENTION

Accordingly, the ensuing description of the apparatus according to the present invention provides a work table having trackways disposed thereon and preferably in parallel relation in which various types of clamps are disposed to travel and be constrained in the trackway thereby providing faces which can engage and contain objects to be worked on so that these objects to be worked on can be handled in an efficient manner. Furthermore, the apparatus does away with cumbersome pipe or channel type clamps and is capable of being utilized in other fashions as simply a work table when the clamping apparatus is not needed.

OBJECTS OF THE INVENTION

Therefore an object of this invention is to provide a work table having improved clamping devices disposed thereon.

Another objects contemplates providing a work table in which the clamping devices are adjustable to accommodate various size articles to be worked on.

These and other objects will be made manifest when considering the following detailed specification and drawings.

BRIEF DESCRIPTION OF THE DRAWINGS

FIG. 1 shows a perspective view of the apparatus according to the present invention;

FIG. 4 is a sectional view taken along lines 4—4 of FIG. 2;

FIG. 5 is a sectional view taken along lines 5—5 of FIG. 2;

FIG. 7 shows an alternate embodiment for a clamping device.

DESCRIPTION OF THE PREFERRED EMBODIMENTS

Figure 3:
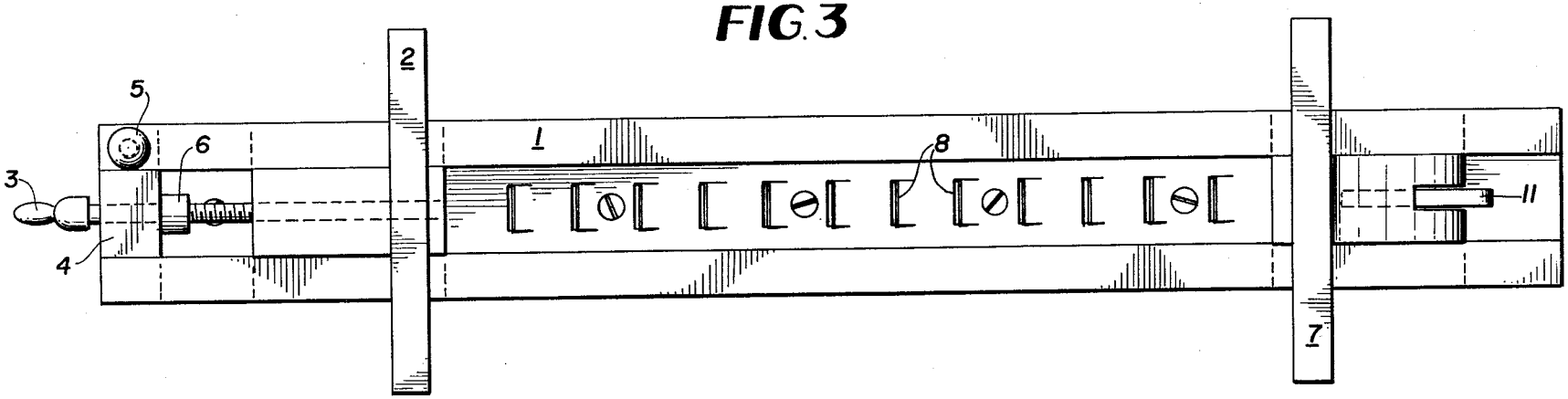
FIG. 3 is a top plan view of the device shown in FIG. 2.

Turning to the drawings now wherein like reference numerals refer to like parts throughout the various drawings, reference numeral 20 is directed to the work table according to the present invention having a plurality of legs supporting the table surface.

Disposed in parallel relationship on the table surface are two trackways reference numeral 1 which can generally be considered as rectangular slots or trackways having the top planer portion partially removed thereby defining a U-shaped channel whose vertical legs have inwardly directed horizontal portions so as to constrain objects riding in this trackway thus formed. A portion of this channel or trackway has upwardly disposed teeth or clamp racks 8 whose purpose will become apparent with the ensuing description.

Figure 6:
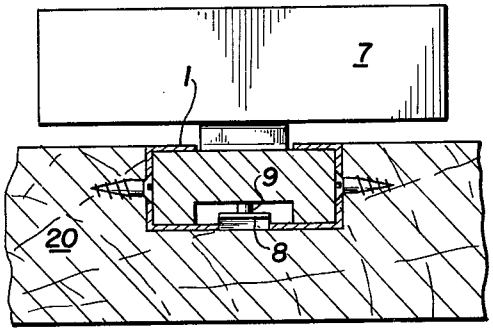
FIG. 6 is a sectional view taken along lines 6—6 of FIG. 2.

A clamp assembly 7 has a lower portion fashioned to slide within the trackway as is best seen in FIG. 6 and has an upstanding portion connected to a generaly horizontally disposed face member which serves as one clamp. This clamp assembly is constrained from motion along the trackway by means of a locking pawl 9 which is biased within the clamp assembly 7 by means of a spring 10. The pawl 9 is capable of engaging the rack elements 8 so that motion is constrained and the clamp assembly is incapable of motion in the right hand sense when viewing FIG. 2 when the pawl engages the rack 8. The pawl may be released from the teeth 8 by means of lever 11 so that as shown in phantom of FIG. 2 the pawl is upwardly disposed and allows the clamp assembly to be translated in the horizontal sense.

Figure 2:
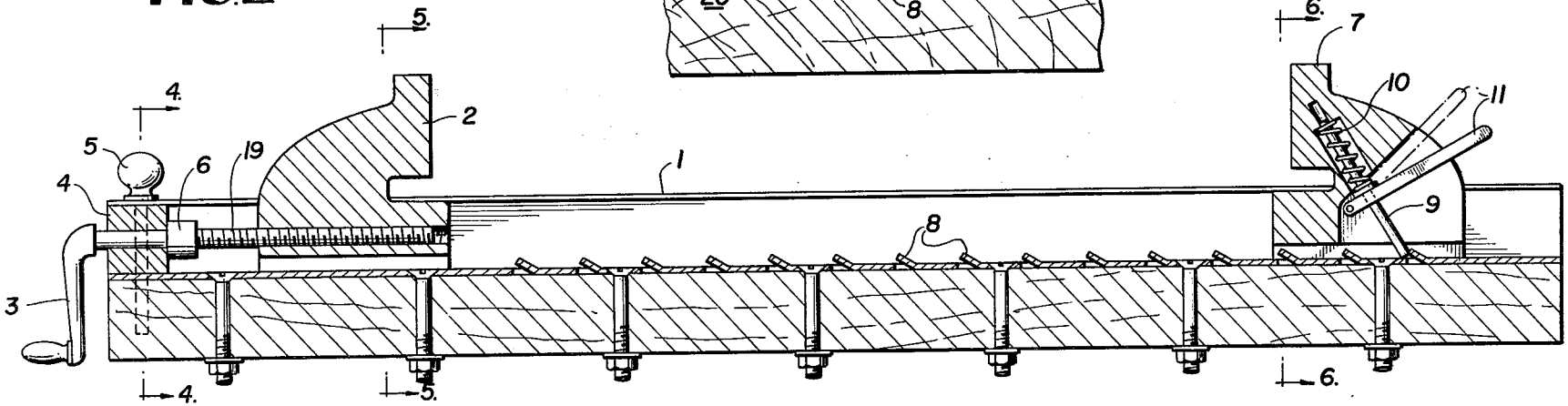
FIG. 2 shows a sectional view of the apparatus of FIG. 1 taken along lines 2—2 of FIG. 1.

Remote from this clamp is another clamping element 2 which has the same general physical configuration but is constrained from motion in the trackway which runs by a different mechanism. FIG. 2 shows the specifics of this. A handle 3 is disposed on a threaded shaft 19 which coacts with clamp 2 by virtue of the threads disposed thereon. The threaded shaft 19 is constrained from lateral displacement by thrust block 4 which has disposed on one face remote from the handle 3 a thrust bearing 6. The thrust block 4 is constrained from horizontal displacement by lock pin 5. Accordingly, when handle 3 is rotated the coaction of threads 19 against clamp 2 causes the clamp to be translated in a horizontal fashion so that a work piece disposed within clamps 7 and 2 can be constrained from motion by tightening clamp 2 towards clamp 7, and conversely can be released when clamp 2 is removed in the opposite direction.

As seen in the sectional views of FIGS. 5 and 6, these clamp assemblies can generally be regarded as having an inverted Y configuration in section and the single leg of the Y has disposed in a transverse fashion relative to the length thereof a clamping face.

FIG. 7 shows an alternative embodiment of a clamping device wherein instead of constraining an object to be worked on between two such clamps as shown in FIG. 1 the object to be worked on is constrained between the table face of the work table 20 and an L-shaped clamp 13 having an adjustable screw member 15 disposed at one extremity of the L-shaped clamp 13, and wherein the other extremity of the L-shaped clamp is caused to ride in the trackway 1 in a slightly different manner from the two previously discussed structural clamps. In this case, the end of the L-shaped clamp remote from the screw member 15 is disposed on a base member 18 in which the interface between L-shaped leg 13 and base member 18 defines a joint 16 which is provided with a mechanism, not shown, so that L-shaped leg 13 can be rotated around plate 18. The block member 18 is constrained within the trackway by having a plate 14 which rides within the trackway connected to the block member 18 through a screw 17 so that when the screw is tightened down, plate 14 abutts against the trackway at the bottom portion thereof and retards any motion within the channel or trackway 1. Conversely, when the pressure is released on screw 17, the lower block 14 is slideably disposed within the trackway, and this clamp assembly can be translated down the channel as is required.

It is to be noted that lock pin 5 constrains the thrust block 4 from horizontal displacement because of pin 5's interlocking relation with the channel or trackway 1. The trackway itself is fastened to the work table by bolts 22, and wood screws 23 also assist to this end.

Having thus described the invention, it will be apparent to those skilled in the art that numerous structural modifications are possible and that they are contemplated as being a part of this invention as specified hereinabove by the description and as claimed hereinbelow.

What is claimed is:

1. An apparatus for clamping objects to be worked on to a work table comprising at least one channel disposed within a top face of said work table, and means slideably disposed within said channel to constrain the object to be worked on so that when said means to constrain are removed, the top face of said work table is free from any upstanding projections, said means to constrain the object to be worked on comprises a first clamp member having a portion slideably disposed within said channel provided with means to coact against said channel to constrain said first clamp from displacement within said channel, and a face member extending above said channel which opposes a face disposed on a second clamp member which has a portion that rides in said channel and is constrained from motion by means of a shaft having threads thereon connected to said second clamp at one extremity and further connected to a handle at the other extremity through a thrust block and thrust washer fastened to said channel by a lock pin and wherein said means to constrain said first clamp in said channel comprise rack means disposed in said channel and a pawl disposed within said first clamp having biasing means disposed thereabout and a lever connected thereto to engage said pawl against said rack and to remove said pawl from contact with said rack.

2. The device of claim 1 in which there are two parallel channels and a first and second clamp in each channel.

3. An apparatus for clamping objects to be worked on to a work table comprising at least one channel disposed within a top face of said work table, and means slideably disposed within said channel to constrain the object to be worked on so that when said means to constrain are removed, the top face of said work table is free from any upstanding projections and in which said means for constraining an object to be worked on to said table comprises an L-shaped leg member disposed above said channel having a screw constraining means disposed at one extremity and having the other extremity of said L-shaped clamp supported on a block member which rides on top of said channel and further comprises a lower block member connected to said upper block member by screw means whereby when said screw is turned in one direction, said lower block presses against a portion of the channel to constrain said clamp from motion and when the screw is turned in the other direction the clamp is free to travel down the channel.

4. The device of claim 3 in which plural parallel channels are provided.

5. An apparatus for clamping objects to be worked on to a work table comprising at least one channel disposed within a top face of said work table, and means slideably disposed within said channel to constrain the object to be worked on so that when said means to constrain are removed, the top face of said work table is free from any upstanding projections and in which said means for constraining an object to be worked on to said table comprises an L-shaped leg member disposed above said channel having a screw constraining means disposed at one extremity and having the other extremity of said L-shaped clamp supported on a block member which rides within said channel and further comprises a clamp member having a portion slideably disposed within said channel provided with means to coact against said channel to constrain said clamp from displacement with said channel.

6. The device of claim 5 wherein said means to constrain said clamp in said channel comprise rack means disposed in said channel and a pawl disposed within said first clamp having biasing means disposed thereabout and a lever connected thereto to engage said pawl against said rack and to remove said pawl from contact with said rack.

7. An apparatus for clamping objects to be worked on to a work table comprising at least one channel disposed within a top face of said work table, and means slideably disposed within said channel to constrain the object to be worked on so that when said means to constrain are removed, the top face of said work table is free from any upstanding projections, and in which said means for constraining an object to be worked on to said table comprises an L-shaped leg member disposed above said channel having a screw constraining means disposed at one extremity and having the other extremity of said L-shaped clamp supported on a block member which rides within said channel and further is constrained from motion by means of a shaft having threads thereon connected to said clamp at one extremity and further connected to a handle at the other extremity through a thrust block and thrust washer fastened to said channel by a lock pin.

8. The device of claim 5 in which plural parallel channels are provided.

9. The device of claim 7 in which plural parallel channels are provided.

* * * * *